US007024133B2

(12) United States Patent
Nagashima et al.

(10) Patent No.: US 7,024,133 B2
(45) Date of Patent: Apr. 4, 2006

(54) IMAGE FORMING APPARATUS USING A USER INSTALLABLE PROCESS CARTRIDGE, A METHOD OF ARRANGING THE PROCESS CARTRIDGE, AND THE PROCESS CARTRIDGE ITSELF

(75) Inventors: Hiroyuki Nagashima, Kanagawa-ken (JP); Atsushi Sampe, Kanagawa-ken (JP); Yoshiyuki Kimura, Tokyo (JP); Nobuo Kuwabara, Kanagawa-ken (JP); Hiroshi Hosokawa, Kanagawa-ken (JP); Hideki Zemba, Kanagawa-ken (JP); Wakako Murakami, Tokyo (JP); Yuji Arai, Kanagawa-ken (JP); Satoshi Narumi, Kanagawa-ken (JP); Kiyonori Tsuda, Kanagawa-ken (JP); Ryuta Takeichi, Kanagawa-ken (JP); Masanori Kawasumi, Kanagawa-ken (JP); Kazuhiko Umemura, Shizuoka-ken (JP)

(73) Assignee: Ricoh Co., Ltd., Tokyo (JP)

( * ) Notice: Subject to any disclaimer, the term of this patent is extended or adjusted under 35 U.S.C. 154(b) by 88 days.

(21) Appl. No.: 10/740,665

(22) Filed: Dec. 22, 2003

(65) Prior Publication Data

US 2004/0170446 A1 Sep. 2, 2004

(30) Foreign Application Priority Data

Dec. 20, 2002 (JP) ..... 2002-371154

(51) Int. Cl.
*G03G 21/16* (2006.01)

(52) U.S. Cl. ..... 399/111; 399/112; 399/117

(58) Field of Classification Search ..... 399/107, 399/111, 112, 299, 306, 108, 110, 113, 116, 399/117
See application file for complete search history.

(56) References Cited

U.S. PATENT DOCUMENTS

| | | | |
|---|---|---|---|
| 4,875,063 | A | 10/1989 | Idenawa et al. |
| 4,950,573 | A | 8/1990 | Yamaguchi et al. |
| 4,985,733 | A | 1/1991 | Kurotori et al. |
| 5,026,621 | A | 6/1991 | Tsubuko et al. |
| 5,061,587 | A | 10/1991 | Tsubuko et al. |
| 5,099,289 | A | 3/1992 | Kurotori et al. |
| 5,169,739 | A | 12/1992 | Umemura et al. |
| 5,189,102 | A | 2/1993 | Tsubuko et al. |
| 5,328,794 | A | 7/1994 | Kazuo et al. |
| 5,482,265 | A | 1/1996 | Nakazato et al. |
| 5,486,909 | A | 1/1996 | Takenaka et al. |
| 5,489,747 | A | 2/1996 | Takenaka et al. |
| 5,552,870 | A | 9/1996 | Murakami et al. |
| 5,610,693 | A | 3/1997 | Sugiyama et al. |
| 5,617,191 | A | 4/1997 | Murakami et al. |
| 5,625,438 | A | 4/1997 | Sugiyama et al. |

(Continued)

FOREIGN PATENT DOCUMENTS

| | | |
|---|---|---|
| EP | 1 162 513 | 12/2001 |

(Continued)

*Primary Examiner*—Hoan Tran
(74) *Attorney, Agent, or Firm*—Oblon, Spivak, McClelland, Maier & Neustadt, P.C.

(57) ABSTRACT

An image forming apparatus includes a frame, a plurality of process cartridges, and a guide mounted to the frame. The guide mounted to the frame includes a plurality of guide portions having supporting surfaces arranged at predetermined different heights and on which the plurality of process cartridges are detachably placed, and is configured to guide the plurality of process cartridges placed on the supporting surfaces along a path between respective first positions and respective second positions.

51 Claims, 12 Drawing Sheets

U.S. PATENT DOCUMENTS 5,625,440 A 4/1997 Matsumae et al.
5,625,441 A 4/1997 Sugiyama et al.
5,627,630 A 5/1997 Matsumae et al.
5,659,860 A 8/1997 Sasaki et al.
5,666,625 A 9/1997 Komatsubara et al.
5,689,782 A 11/1997 Murakami et al.
5,697,026 A 12/1997 Matsumae et al.
5,708,942 A 1/1998 Sugiyama et al.
5,740,507 A 4/1998 Ichikawa et al.
5,758,241 A 5/1998 Oyama et al.
5,759,733 A 6/1998 Tsubuko et al.
5,768,665 A 6/1998 Yamanaka et al.
5,771,426 A 6/1998 Oka et al.
5,771,429 A 6/1998 Oyama et al.
5,805,965 A 9/1998 Tsuda et al.
5,819,145 A 10/1998 Tanaka et al.
5,822,664 A 10/1998 Oka et al.
5,826,144 A 10/1998 Takenaka et al.
5,845,183 A 12/1998 Sugiyama et al.
5,879,752 A 3/1999 Murakami et al.
5,915,155 A 6/1999 Shoji et al.
5,930,561 A 7/1999 Hosokawa et al.
5,952,048 A 9/1999 Tsubuko et al.
5,999,772 A 12/1999 Kakitani et al.
6,014,532 A 1/2000 Takeichi et al.
6,033,818 A 3/2000 Sugiyama et al.
6,060,205 A 5/2000 Takeichi et al.
6,118,964 A 9/2000 Kojima et al.
6,125,243 A 9/2000 Shoji et al.
6,160,977 A 12/2000 Takeichi et al.
6,163,666 A 12/2000 Hosokawa et al.
6,198,895 B1 3/2001 Tsuda et al.
6,212,343 B1 4/2001 Hosokawa et al.
6,249,661 B1 6/2001 Saitoh et al.
6,337,957 B1 1/2002 Tamaki et al.
6,363,237 B1 3/2002 Nagame et al.
6,447,973 B1 9/2002 Asami et al.
6,493,529 B1 12/2002 Umemura et al.
6,521,386 B1 2/2003 Sakon et al.
6,522,855 B1 2/2003 Katoh et al.
6,558,862 B1 5/2003 Kojima et al.
6,560,431 B1 5/2003 Hosokawa
6,562,529 B1 5/2003 Kojima et al.
6,615,013 B1 9/2003 Arai et al.
6,697,588 B1 * 2/2004 Nakazato et al. ..... 399/111
6,697,595 B1 2/2004 Kawagoe et al.
6,706,459 B1 3/2004 Kojima et al.
6,798,430 B1 * 9/2004 Sato ..... 347/115
6,836,629 B1 * 12/2004 Miyabe et al. ..... 399/111
2004/0126134 A1 * 7/2004 Harada et al. ..... 399/114
2004/0170447 A1 * 9/2004 Arai et al. ..... 399/111
2005/0047823 A1 * 3/2005 Nakashima et al. ..... 399/111

FOREIGN PATENT DOCUMENTS

JP 5-313426 11/1993
JP 9-120203 5/1997
JP 10-039718 2/1998
JP 11-95520 4/1999
JP 2002-6679 1/2002
JP 2002-108173 4/2002

* cited by examiner

IMAGE FORMING APPARATUS USING A USER INSTALLABLE PROCESS CARTRIDGE, A METHOD OF ARRANGING THE PROCESS CARTRIDGE, AND THE PROCESS CARTRIDGE ITSELF

CROSS REFERENCE TO RELATED APPLICATIONS

The present application claims priority under 35 U.S.C. § 119 to Japanese Patent Application No. 2002-371154 filed on Dec. 20, 2002, the entire contents of which is incorporated herein by reference.

BACKGROUND OF THE INVENTION

1. Field of the Invention

The present invention relates to an image forming apparatus, and more particularly to an image forming apparatus which uses a user installable process cartridge by employing an improved guiding mechanism, and a method of arranging the process cartridge and to the process cartridge itself.

2. Discussion of the Background

Some background color image forming apparatuses use a plurality of process cartridges detachably mountable therein for forming toner images to be superimposed one after another into a full-color image.

Such background color image forming apparatuses are commonly known as electrophotographic copying machines, printing machines, facsimile apparatuses, and multifunctional apparatuses having at least two functions of copying, printing and facsimile functions. An example of the background color image forming apparatuses is described in a reference of Japanese laid-open patent application No. 2002-6679. This background color image forming apparatus uses a process cartridge in which an image bearing member and an image forming mechanism, or at least a portion of the image forming mechanism, are integrally mounted. The process cartridge is removably arranged inside the image forming apparatus, allowing the image bearing member and the image forming mechanism to be checked, repaired and replaced.

Further, in one of these background color image forming apparatuses, a plurality of such process cartridges are arranged serially along an angled plane relative to a horizontal plane.

The background image forming apparatus has a structure in which a slide rail provided to the process cartridge is arranged slidable along a guide rail provided to the image forming apparatus to allow the process cartridge to be removed or inserted.

However, in the background color image forming apparatus using a guiding device that includes such a guide rail and a slide rail, the slide rail needs to be properly engaged with the guide rail such that each process cartridge is installed in the image forming apparatus with a fine positioning. This installation of the process cartridge is difficult for an inexperienced person or a user. Further, the user may be embarrassed because it is difficult for him or her to instantly find a location of the guide rail in the image forming apparatus.

SUMMARY OF THE INVENTION

One object of the present invention is to provide a novel image forming apparatus that includes a frame, a plurality of process cartridges, and a guide mounted to the frame. The guide includes a plurality of guide portions that have supporting surfaces arranged at predetermined different heights and on which the plurality of process cartridges are detachably placed. Further, the guide is configured to guide the plurality of process cartridges placed on the supporting surfaces along a path between respective first positions and respective second positions.

Another object of the present invention is to provide a novel image forming apparatus that includes a frame, a plurality of process cartridges, and means for holding and for guiding. The plurality of process cartridges are configured to sequentially form color toner images with toners of predetermined colors different from each other to form a full-color image in each image forming cycle. The means for holding and for guiding holds the plurality of process cartridges which are downwardly placed thereto at predetermined different heights and guides the plurality of process cartridges along a path between respective first positions to respective second positions.

Yet another object of the present invention is to provide a novel method of a process cartridge loading arrangement for an image forming apparatus that includes providing a guide that has a plurality of guide portions with supporting surfaces arranged at predetermined different heights, placing a plurality of process cartridges detachably on the supporting surfaces of the plurality of guide portions of the guide, and guiding the plurality of process cartridges placed on the supporting surfaces from respective first positions to respective second positions.

Another object of the present invention is to provide a novel detachable process cartridge for an image forming apparatus that includes a bottom that has an approximately plane surface held in contact by a supporting member of the image forming apparatus, and a side surface that includes an engaging portion configured to engage with a guide of the image forming apparatus.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
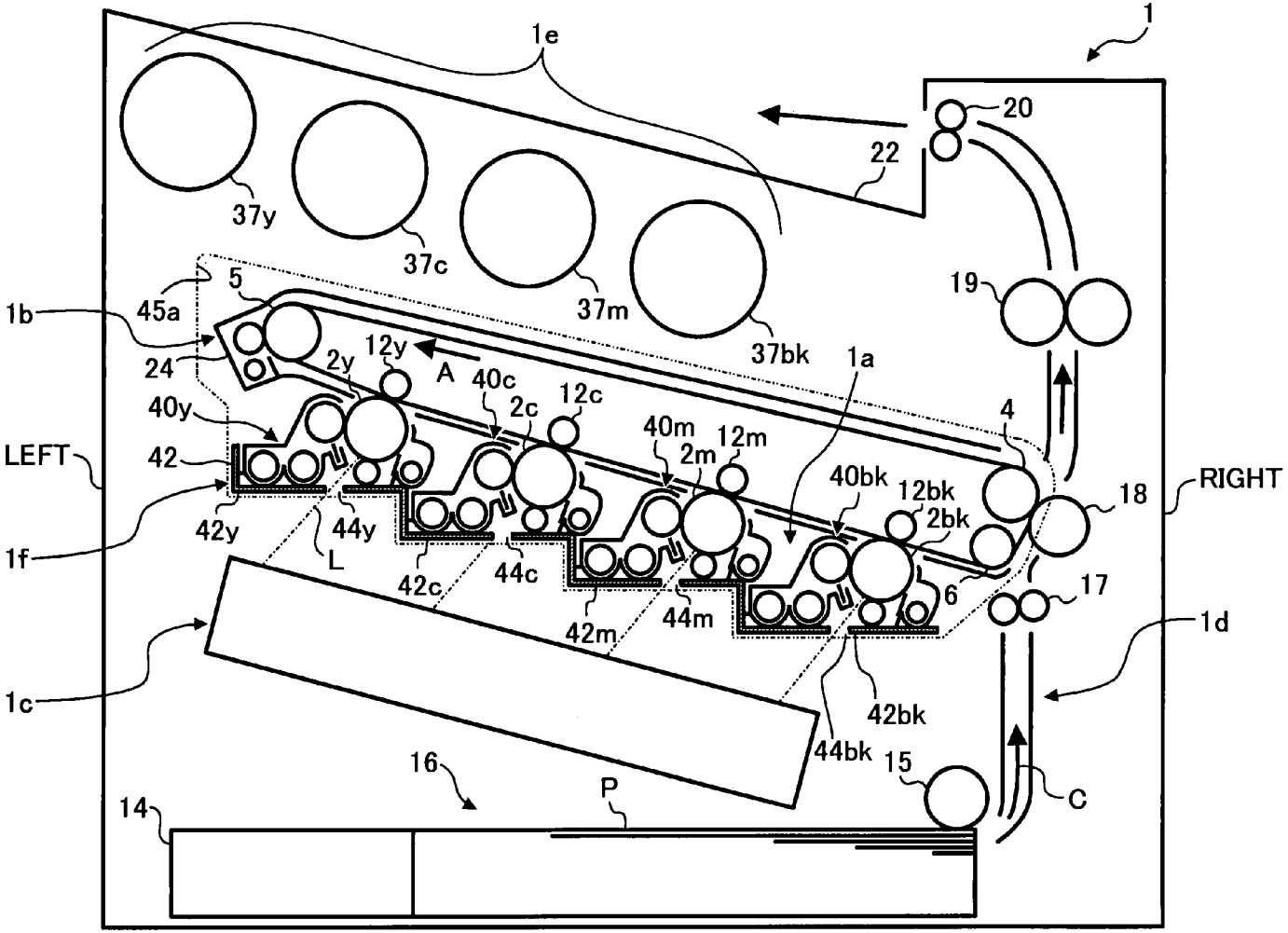
FIG. 1 illustrates a vertical sectional view of a full-color image forming apparatus according to an embodiment of the present invention.

Referring now to the drawings, wherein like reference numerals designate identical or corresponding parts throughout the several views, preferred embodiments of the present invention are described.

Referring to FIG. 1, an image forming apparatus 1 is shown that includes an image forming mechanism 1*a*, a transfer medium 1*b*, an optical writing system 1*c*, a sheet feeding mechanism 1*d*, a toner feeding mechanism 1*e*, and a guiding mechanism 1*f*.

Figure 2:
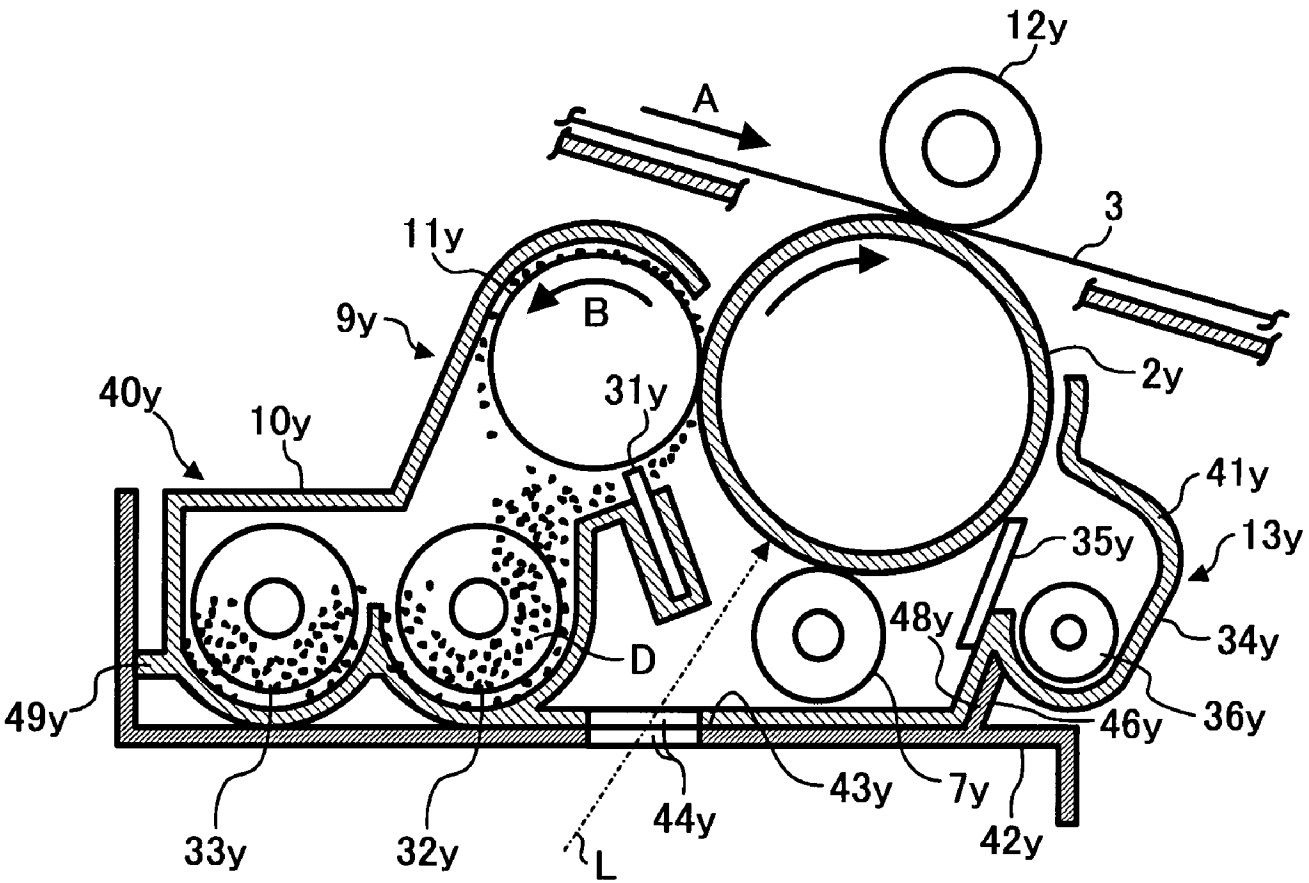
FIG. 2 illustrates an enlarged sectional view of an image bearing member and an image forming mechanism arranged around the image bearing member.

The image forming mechanism 1*a* generally includes four process cartridges 40*y*, 40*c*, 40*m* and 40*bk* which are explained with reference to FIG. 2. FIG. 2 illustrates an enlarged sectional view of the process cartridge 40*y*, focusing on operations of the process cartridge 40*y*. The process cartridges 40*y*, 40*c*, 40*m* and 40*bk* have identical structures with toners of different colors. The process cartridge 40*y* includes an image bearing member 2*y* and various image forming components including a charging roller 7*y*, a developing unit 9*y*and a cleaning unit 13*y*. The developing unit 9*y* includes a developing roller 11*y*, a developing blade 31*y*, and toner conveying screws 32*y* and 33*y*. The parts of the developing unit 9*y* are encased in a developing case 10*y* that contains a dry-type developer D. The cleaning unit 13*y* includes a cleaning blade 35*y* and a collected-toner conveying screw 36*y*. The parts of the cleaning unit 13*y* are encased in a cleaning case 34*y*. According to the image forming apparatus 1 of the present invention, the developing case 10*y* and the cleaning case 34*y* are integrally mounted to form a unit case 41*y*. The unit case 41*y* has a light passing window 44*y* at the bottom thereof.

The transfer medium 1*b* includes an intermediate transfer belt 3. The intermediate transfer belt 3 is supported by a plurality of supporting rollers 4, 5 and 6, and is held in contact with primary transfer rollers 12*y*, 12*c*, 12*m* and 12*bk* which correspond to the image bearing members 2*y*, 2*c*, 2*m* and 2*bk*, respectively.

The optical writing system 1*c* includes an optical writing device.

The sheet feeding mechanism 1*d* includes a sheet feeding cassette 14, a sheet feeding roller 15, a sheet feeding unit 16, a registration roller pair 17, a secondary transfer roller 18, a fixing unit 19, a sheet discharging roller pair 20, a sheet discharging part 22 and a belt cleaning unit 24.

The toner feeding mechanism 1*e* includes toner bottles 37*y*, 37*c*, 37*m* and 37*bk*.

The guiding mechanism 1*f* includes a guide 42 having guide portions 42*y*, 42*c*, 42*m* and 42*bk* which are explained with reference to FIG. 3. The guide portions 42*y*, 42*c*, 42*m* and 42*bk* have supporting surfaces 43*y*, 43*c*, 43*m* and 43*bk*, and guide protrusions 46*y*, 46*c*, 46*m* and 46*bk*, respectively.

The image forming apparatus 1 of the present invention also includes an opening 45*a* (shown in FIG. 5) on a front side panel thereof.

The intermediate transfer belt 3 is arranged above the image forming mechanism 1*a* at a predetermined angle relative to the horizontal plane with one end of the intermediate transfer belt 3 close to the supporting roller 5 higher than the other end thereof. The predetermined angle is preferably in a range from approximately 10 degrees to approximately 20 degrees, and is preferably approximately 15 degrees.

The image forming apparatus 1 produces a full-color image through the following operations. The optical writing system 1*c* emits laser beams to the image forming mechanism 1*a* supported by the guiding mechanism 1*f*. The image forming mechanism 1*a* produces different color images with toners which are conveyed by the toner feeding mechanism 1*e*, and transfers the images one after another onto the transfer medium 1*b* to form a superimposed full-color image. The transfer medium 1*b* then transfers the superimposed full-color image onto a recording medium fed by the sheet feeding mechanism 1*d*. The full-color image transferred onto the recording medium 1*b* is fixed and then discharged onto the top of the image forming apparatus 1.

Referring to FIG. 2, operations of the image forming mechanism 1*a* are explained. As previously described, the process cartridges 40*y*, 40*c*, 40*m* and 40*bk* have identical structures. Therefore, an explanation will be given focusing on the operations performed by the process cartridge 40*y*.

The image bearing member 2*y* has a drum-shaped photoconductive element and forms an electrostatic latent image for a single color toner image on its surface. The image forming components are arranged around the image bearing member 2*y* and form the single color toner image based on the electrostatic latent image formed on the image bearing member 2*y*.

The image bearing member 2*y* rotates clockwise. The charging roller 7*y* is applied with a charged voltage and then charges the image bearing member 2*y* to a predetermined polarity to form an electrostatic latent image on the image bearing member 2*y*. The optical writing system 1*c* emits and irradiates the image bearing member 2*y* with a laser beam L.

The developing unit 9*y* visualizes the electrostatic latent image as a yellow toner image. The developing roller 11*y* is rotatably supported by the developing case 10*y* and is closely placed opposite to the image bearing member 2*y* through an open space formed on the developing case 10*y*. The developing blade 31*y* regulates an amount of the dry-type developer D on the developing roller 11*y*. The toner conveying screws 32*y* and 33*y* are oppositely provided to the developing roller 11*y*. The dry-type developer D in the developing case 10*y* is agitated by the toner conveying screws 32*y* and 33*y*, carried onto a surface of the developing roller 11*y*, and then conveyed by the developing roller 11*y* rotating in a direction B, as indicated in FIG. 2. The developing blade 31*y* regulates the dry-type developer D accumulated on the surface of the developing roller 11*y* to a fixed level. The dry-type developer D of the regulated amount adhering on the developing roller 11*y* is conveyed to a developing area formed between the developing roller 11*y* and the image bearing member 2*y*. In the developing area, toner contained in the dry-type developer D is electrostatically transferred onto an electrostatic latent image formed on the surface of the image bearing member 2*y* such that the electrostatic latent image becomes visualized as a toner image. The dry-type developer D may be a one-component developer or a two-component developer. The present invention preferably uses the two-component developer including toner and carriers.

As shown in FIG. 1, the intermediate transfer belt 3 that serves as the transfer medium 1*b* forms an endless belt extended with pressure among the plurality of supporting rollers 4, 5 and 6, and rotates in a direction A. The intermediate transfer belt 3 is arranged with an angle to a horizontal plane in an obliquely downward direction from left (LEFT) to right (RIGHT) of the image forming apparatus 1 in FIG. 1. The intermediate transfer belt 3 is held in contact between the primary transfer roller 12*y* arranged at a position opposite to the image bearing member 2*y* such that the toner image formed on the surface of the image bearing member 2*y* is transferred onto the intermediate transfer belt 3 to superimpose different color toner images to obtain a recorded image. The primary transfer roller 12*y* receives a transfer voltage and primarily transfers a yellow toner image onto the surface of the intermediate transfer belt 3 by an action of the transfer voltage.

As shown in FIG. 2, after the yellow toner image is transferred onto the intermediate transfer belt 3, the cleaning unit 13*y* scrapes the surface of the image bearing member 2*y* to remove residual toner adhering to the surface of the image bearing member 2*y*.

The cleaning unit 13*y* is encased by the cleaning case 34*y* that has an opening relative to the image bearing member 2*y*. The cleaning blade 35*y* has a base edge fixedly supported by the cleaning case 34*y* and a leading edge pressed onto the surface of the image bearing member 2*y* to scrape the residual toner adhering to the surface of the image bearing member 2*y*. The collected-toner conveying screw 36*y* conveys removed toner to a toner collecting bottle (not shown).

The charging roller 7*y* is applied a voltage generated by a current that includes a direct current and a superimposed alternating current. The charging roller 7*y* simultaneously discharges and charges the surface of the image bearing member 2*y* with the voltage applied. Namely, the image bearing member 2*y* is prepared for a next image forming operation. Thus, a yellow toner image is formed on the image bearing member 2*y* and is transferred onto the intermediate transfer belt 3.

Through operations similar to those as described above, a cyan toner image, a magenta toner image and a black toner image are formed on the surfaces of the image bearing members 2*c*, 2*m* and 2*bk*, respectively. Those color toner images are sequentially superimposed on the surface of the intermediate transfer belt 3 on which the yellow toner image is already formed, such that a primary superimposed toner image is formed on the intermediate transfer belt 3. After the toner images in the different colors are transferred, residual toner on the image bearing members 2*c*, 2*m* and 2*bk* is also removed by the cleaning units 13*c*, 13*m* and 13*bk*, respectively. As shown in FIG. 1, the image forming components have the same numbers as those corresponding to and arranged around the image bearing member 2*y*, with respective characters "c", "m" and "bk" according to their respective colors.

As shown in FIG. 1, the sheet feeding mechanism 1*d* is arranged at the lower part of the image forming apparatus 1. The sheet feeding cassette 14 accommodates a plurality of recording media such as transfer sheets that include a recording medium P. The sheet feeding roller 15 is provided at the top of the sheet feeding unit 16 and feeds recording media. When the sheet feeding roller 15 is rotated, the recording medium P, placed on the top of a sheet stack of recording media in the sheet feeding cassette 14, is fed in a direction C as indicated in FIG. 1. The recording medium P, fed from the sheet feeding cassette 14, is conveyed to the registration roller pair 17. The registration roller pair 17 stops and feeds the recording medium P in synchronization with a movement of the superimposed toner image towards a transfer area formed between the intermediate transfer belt 3 and the secondary transfer roller 18. The secondary transfer roller 18 is applied with an adequate predetermined transfer voltage such that a primary superimposed toner image, formed on the surface of the intermediate transfer belt 3, is transferred onto the recording medium P to form a secondary superimposed toner image.

The recording medium P that has the secondary superimposed toner image thereon is conveyed further upward and passes between a pair of fixing rollers of the fixing unit 19. The fixing unit 19 fixes the secondary superimposed toner image to the recording medium P by applying heat and pressure. After the recording medium P passes the fixing unit 19, the recording medium P is discharged face-down by the sheet discharging roller pair 20 to the sheet discharging part 22 provided at the upper portion of the image forming apparatus 1. The belt cleaning unit 24 scrapes the surface of the intermediate belt 3 and removes residual toner adhering onto the surface of the intermediate transfer belt 3.

As shown in FIG. 1, the toner bottles 37*y*, 37*c*, 37*m* and 37*bk* of the toner feeding mechanism 1*e* are provided at the upper portion of the image forming apparatus 1 and contain yellow, cyan, magenta and black toners, respectively. Yellow, cyan, magenta and black toners are conveyed from the toner bottles 37*y*, 37*c*, 37*m* and 37*bk*, respectively, through respective conveying paths (not shown) to supply the developing units 9*y*, 9*c*, 9*m* and 9*bk*, respectively.

As previously described, a process cartridge (40*y*, 40*c*, 40*m* and 40*bk*) is formed by an image bearing member (2*y*, 2*c*, 2*m* and 2*bk*) and at least a part of the image forming mechanism 1*a*. The image bearing member (2*y*, 2*c*, 2*m* and 2*bk*) has a surface on which an electrostatic latent image for a corresponding color out of predetermined colors is formed. The image forming mechanism 1*a* is integrally mounted with the image bearing member (2*y*, 2*c*, 2*m* and 2*bk*). The image forming mechanism 1*a* is configured to form a toner image in a corresponding color based on the electrostatic latent image formed on the image bearing member (2*y*, 2*c*, 2*m* and 2*bk*). The image forming apparatus 1 includes a plurality of process cartridges (40*y*, 40*c*, 40*m* and 40*bk*) configured to transfer yellow, cyan, magenta and black toner images, respectively, formed on the image bearing members 2*y*, 2*c*, 2*m* and 2*bk*, respectively, into a full-color toner image onto the intermediate transfer belt 3. More specifically, in the process cartridge 40*y*, the developing case 10*y* and the cleaning case 34*y* are integrally formed as a unit case 41*y*, as shown in FIG. 2. The image bearing member 2*y* is rotatably supported by the unit case 41*y*. The image bearing member 2*y*, developing unit 9*y*, cleaning unit 13*y*and charging roller 7*y* are integrally mounted to form process cartridge 40*y*. As previously described, the process cartridge does not necessarily include an entire portion of the image forming mechanism. The process cartridge may include the image bearing member and at least one of the charging unit, the developing unit and the cleaning unit.

The image bearing members 2*y*, 2*c*, 2*m* and 2*bk* are in contact with a bottom surface of the intermediate transfer belt 3 between the supporting rollers 5 and 6, and are arranged such that the supporting roller 5 is disposed higher than the supporting roller 6. As shown in FIG. 1, the process cartridges 40*y*, 40*c*, 40*m* and 40*bk* may be removed in an axial direction of the image bearing members 2*y*, 2*c*, 2*m* and 2*bk*, respectively.

Figure 3:
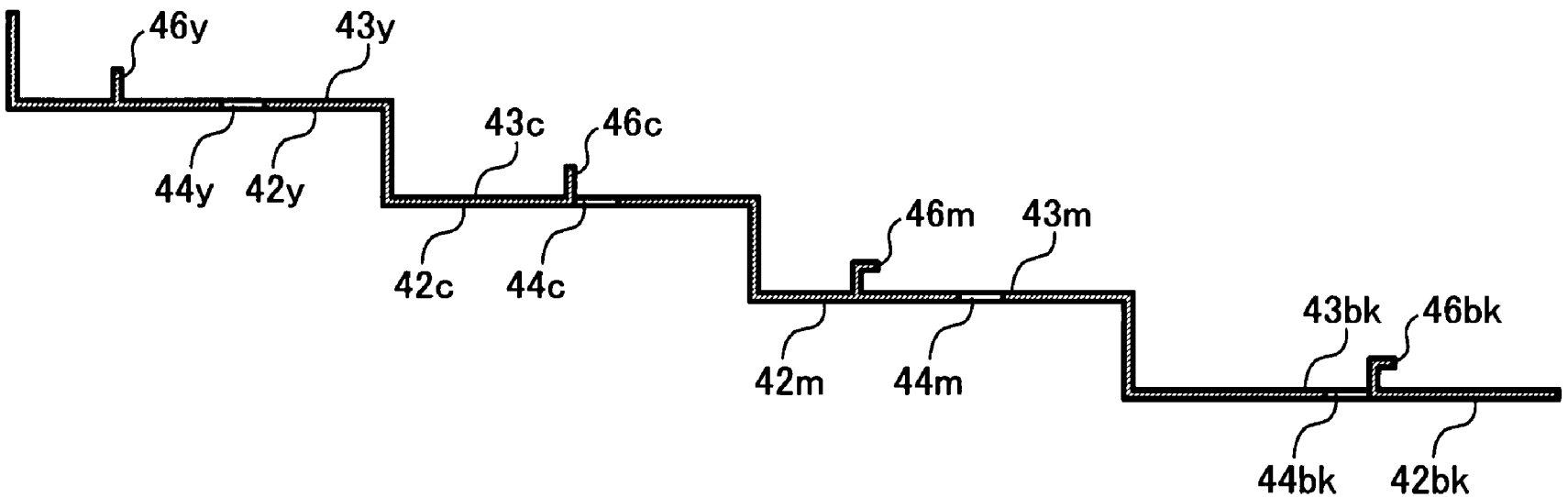
FIG. 3 illustrates a sectional view of a guide having guide portions arranged in a stepped manner.

FIG. 3 illustrates a sectional view of the guide 42 including the guide portions 42*y*, 42*c*, 42*m* and 42*bk* arranged in a stepped manner, according to an embodiment of the present invention. The guide 42 includes the guide portions 42*y*, 42*c*, 42*m* and 42*bk*, and is fixed to the image forming apparatus 1. The supporting surfaces 43*y*, 43*c*, 43*m* and 43*bk* are mounted substantially horizontal and have respective bottom and side surfaces for supporting the process cartridges 40*y*, 40*c*, 40*m* and 40*bk*. The supporting surfaces 43*y*, 43*c*, 43*m* and 43*bk* guide the process cartridges 40*y*, 40*c*, 40*m* and 40*bk* when the process cartridges 40*y*, 40*c*, 40*m* and 40*bk* are inserted into or removed from the image forming apparatus 1. The supporting surfaces 43*y*, 43*c*, 43*m* and 43*bk* guide the process cartridges 40*y*, 40*c*, 40*m* and 40*bk*, respectively, and are arranged at positions having different heights in a stepped manner according to heights of positions of the process cartridges 40*y*, 40*c*, 40*m* and 40*bk*. The guide portions 42*y*, 42*c*, 42*m* and 42*bk* of the guide 42 support the process cartridges 40*y*, 40*c*, 40*m* and 40*bk*, and have a predetermined angle to the horizontal plane and are arranged parallel to the intermediate transfer belt 3. The guide portions 42*y*, 42*c*, 42*m* and 42*bk* and the unit cases 41*y*, 41*c*, 41*m* and 41*bk* of the process cartridges 40*y*, 40*c*, 40*m* and 40*bk* include the light passing windows 44*y*, 44*c*, 44*m* and 44*bk*, respectively, for passing a laser beam L emitted by the optical writing system 1*c* to the image bearing members 2*y*, 2*c*, 2*m* and 2*bk*, respectively.

Further, as shown in FIG. 2, the developing case 10*y* includes a convex portion 49*y* in the vicinity of the toner conveying screw 33*y* such that the process cartridge 40*y* is guided along a vertical side of the guide portion 42*y*. The other developing cases 10*c*, 10*m* and 10*bk* are arranged in a similar manner. Accordingly, the vertical side of the guide portion 42*y* is also used as a guide member for the process cartridge 40*y*.

Figure 5:
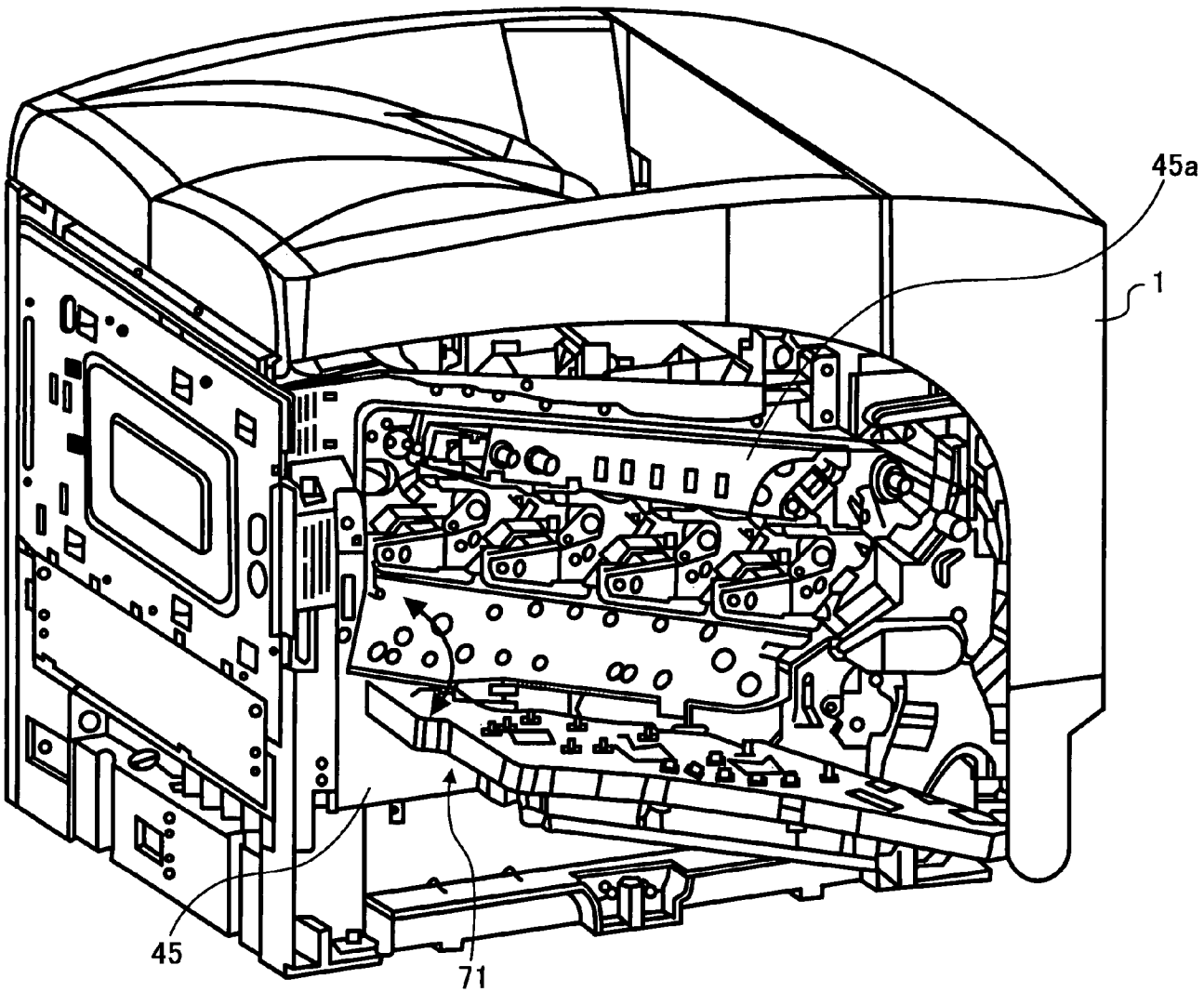
FIG. 5 illustrates a perspective view of the image forming apparatus of FIG. 1 with a cover plate opened, the cover plate being provided to a front side of the image forming apparatus.

The image forming apparatus 1 includes an internal front panel 45 (see FIG. 5) disposed over an internal front side of the image forming apparatus 1 (the surface side of the figure). The internal front side panel 45 covers the internal portions of the image forming apparatus 1 including the process cartridges 40*y*, 40*c*, 40*m* and 40*bk*, the intermediate transfer belt 3, and the optical writing system 1*c*. The internal front panel 45 has an opening 45*a* formed as indicated by the chain double-dashed lines shown in FIG. 1. The process cartridges 40*y*, 40*c*, 40*m* and 40*bk* are removable through the opening 45*a*. Further, the image forming apparatus 1 includes a cover plate 71 which is hingedly mounted to the internal front panel 45 to cover the opening 45*a*. The cover plate 71 may be opened and closed, and has a shape for determining precision positions of the process cartridges 10*y*, 40*c*, 40*m* and 40*bk*. For instance, holes may be used for determining precision positions of the process cartridges 40*y*, 40*c*, 40*m* and 40*bk*. When the cover plate 71 is set to a closed position, an engaging mechanism (not shown) completely fixes positions of the image bearing members of the process cartridges to perform the image forming operation. FIG. 5 illustrates a perspective view of the image forming apparatus 1 and shows a relationship between the opening 45*a* and the cover plate 71.

According to this configuration, when the process cartridge 40*y* is checked, repaired or replaced, a user may pull the process cartridge 40*y* in a direction towards the user to detach it from the supporting surface 43*y*. The user may place and push the process cartridge 40*y* on the supporting surface 43*y* in a reverse direction to attach it. Namely, the user may remove and insert the process cartridge while keeping it horizontal. Therefore, there is no need to engage the slide rail provided on the process cartridge with the guide rail provided on the image forming apparatus. Further, by opening the cover plate 71 of the image forming apparatus 1, the user may instantly recognize the position of the supporting surface 43*y* and understand that the supporting surface 43*y* may be used to guide the process cartridge 40*y* when the process cartridge 40*y* is inserted or removed. Thus, even an inexperienced user may easily attach and detach the process cartridge 40*y* while keeping it horizontal. This process may also be applied to the other process cartridges 40*c*, 40*m* and 40*bk*.

Further, the image forming apparatus 1 includes a regulating member configured to regulate a path of the process cartridge. The regulating member prevents the process cartridge from undesirable movements in a direction perpendicular to the path of the process cartridge along the plane of the supporting surface of the guide during attachment and detachment. Thus, the process cartridge does not cause interference and damage to another process cartridge placed next to it. As shown in FIG. 2, the guide portion 42*y* includes the regulating member that has a guide protrusion 46*y* protruding upward from the supporting surface 43*y* of the guide portion 42*y* and extending toward a removing direction of the process cartridge 40*y*. The guide protrusion 46*y* may be slidably engaged in a groove 48*y* formed on the unit case 41*y* of the process cartridge 40*y* to prevent the process cartridge 40*y* from undesirable movements in a direction perpendicular to the path of the process cartridge 40*y* during attachment and detachment. Alternatively, the process cartridge 40*y* may include the guide protrusion 46*y* and the supporting surface 43*y* may include the groove 48*y*. The processes described above relating to the yellow toner as indicated by the character "y" may also be applied to parts and units related to the cyan, magenta and black toners as indicated by the characters "c", "m" and "bk".

In FIG. 3, the guide portions 42*y*, 42*c*, 42*m*, and 42*bk* may include the guiding protrusions 46*y*, 46*c*, 46*m*, and 46*bk*, and may have different shapes and mounting locations to properly engage respective grooves included in the process cartridges 40*y*, 40*c*, 40*m*, and 40*bk*.

Figure 4:
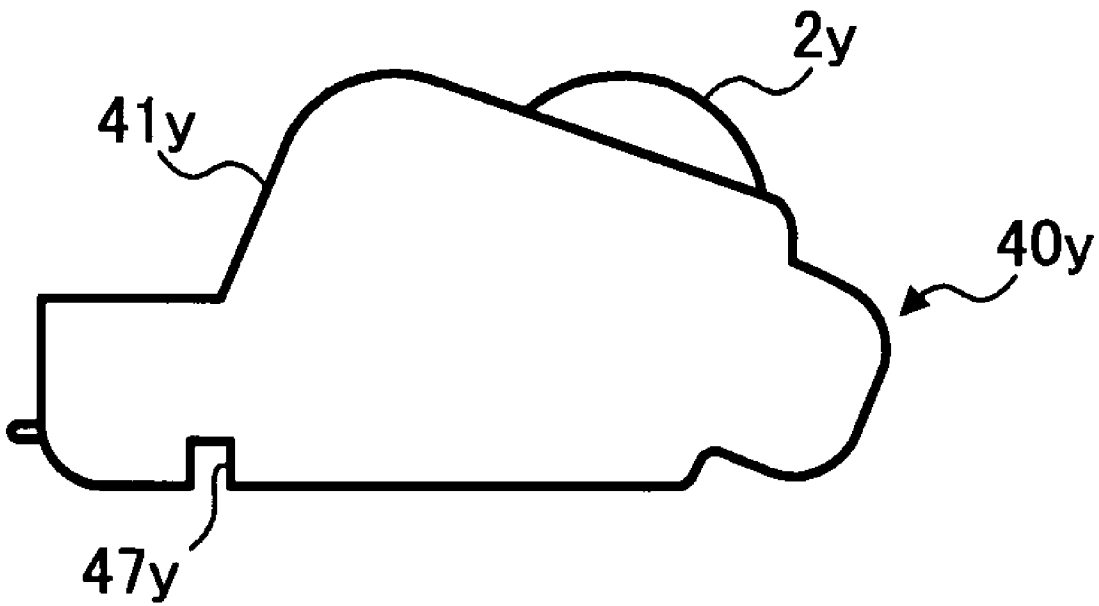
FIG. 4 illustrates a process cartridge provided with a guide groove engaged with the guide protrusion.

FIG. 4 shows an illustration of the unit case 41*y* of the process cartridge 40*y* that has a guide groove 47*y* thereon. The unit case 41*y* of the process cartridge 40*y* includes the guide groove 47*y* which may be engaged with the guide protrusion 46*y* included in the guide portion 44*y* close to the vertical side of the guide portion 44*y*, as shown in FIG. 3. Improper insertion of the process cartridges may be prevented by varying the form or the locations of the guide protrusions and the guide grooves. Alternatively, the guide portions 42*y*, 42*c*, 42*m* and 42*bk* may include the guide grooves 47*y*, 47*c*, 47*m* and 47*bk* and the process cartridges 40*y*, 40*c*, 40*m* and 40*bk* may include the guide protrusions 46*y*, 46*c*, 46*m*, and 46*bk* such that the process cartridges 40*y*, 40*c*, 40*m* and 40*bk* are prevented from being misaligned. Thus, an improper insertion of process cartridge may also be prevented. An erroneous supply of improper color toner to a developing unit may also be prevented. As a result, the quality deterioration of the image due to color toner mixture is avoided.

Further, the image forming apparatus 1 includes an elevating member (not shown) which allows the guide portions 42*y*, 42*c*, 42*m* and 42*bk* to move vertically. When detaching the process cartridges 40*y*, 40*c*, 40*m* and 40*bk*, the elevating member descends the guide portions 42*y*, 42*c*, 42*m* and 42*bk* supporting the process cartridges 40*y*, 40*c*, 40*m* and 40*bk* such that the image bearing members 2*y*, 2*c*, 2*m* and 2*bk* separate from the intermediate transfer belt 3. The separation avoids rubbing and damaging the surfaces of the image bearing members 2*y*, 2*c*, 2*m* and 2*bk*, and the surface of the intermediate transfer belt 3. The guide portions 42*y*, 42*c*, 42*m* and 42*bk* may be configured to elevate collectively or individually. If the guide portions 42*y*, 42*c*, 42*m* and 42*bk* are individually movable, a user can selectively descend the guide portions 42*y*, 42*c*, 42*m* and 42*bk* to attach or detach a desired process cartridge.

Alternatively, the intermediate transfer belt 3 may be eliminated with the images directly transferred onto a recording paper sheet.

As shown in FIG. 1, the image forming apparatus 1 includes toner bottles 37*y*, 37*c*, 37*m* and 37*bk* which are separately mounted to the process cartridges 40*y*, 40*c*, 40*m* and 40*bk*, respectively. The toner bottles 37*y*, 37*c*, 37*m* and 37*bk* of different colors are provided above the intermediate transfer belt 3 and correspond to the process cartridges 40*y*, 40*c*, 40*m* and 40*bk*, respectively, such that each color toner is conveyed to a corresponding one of the process cartridges 40*y*, 40*c*, 40*m* and 40*bk*. The toner bottles 37*y*, 37*c*, 37*m* and 37*bk* may be replaced separately from the process cartridges 40*y*, 40*c*, 40*m* and 40*bk* when a toner needs to be replenished. Also, the process cartridges 40*y*, 40*c*, 40*m* and 40*bk* may be replaced separately from the toner bottles 37*y*, 37*c*, 37*m* and 37*bk* when a component needs to be replaced. Thus, this structure allows separate exchanges of toner and process cartridges, thereby reducing the maintenance cost for the user. Therefore, the number of opening and closing operations of the cover plate 71 may be reduced and the number of replacements of the process cartridges may also be reduced. Thereby, toner scattering in an area such as a shutter area may be prevented and operator-maintainability is improved.

Figure 6:
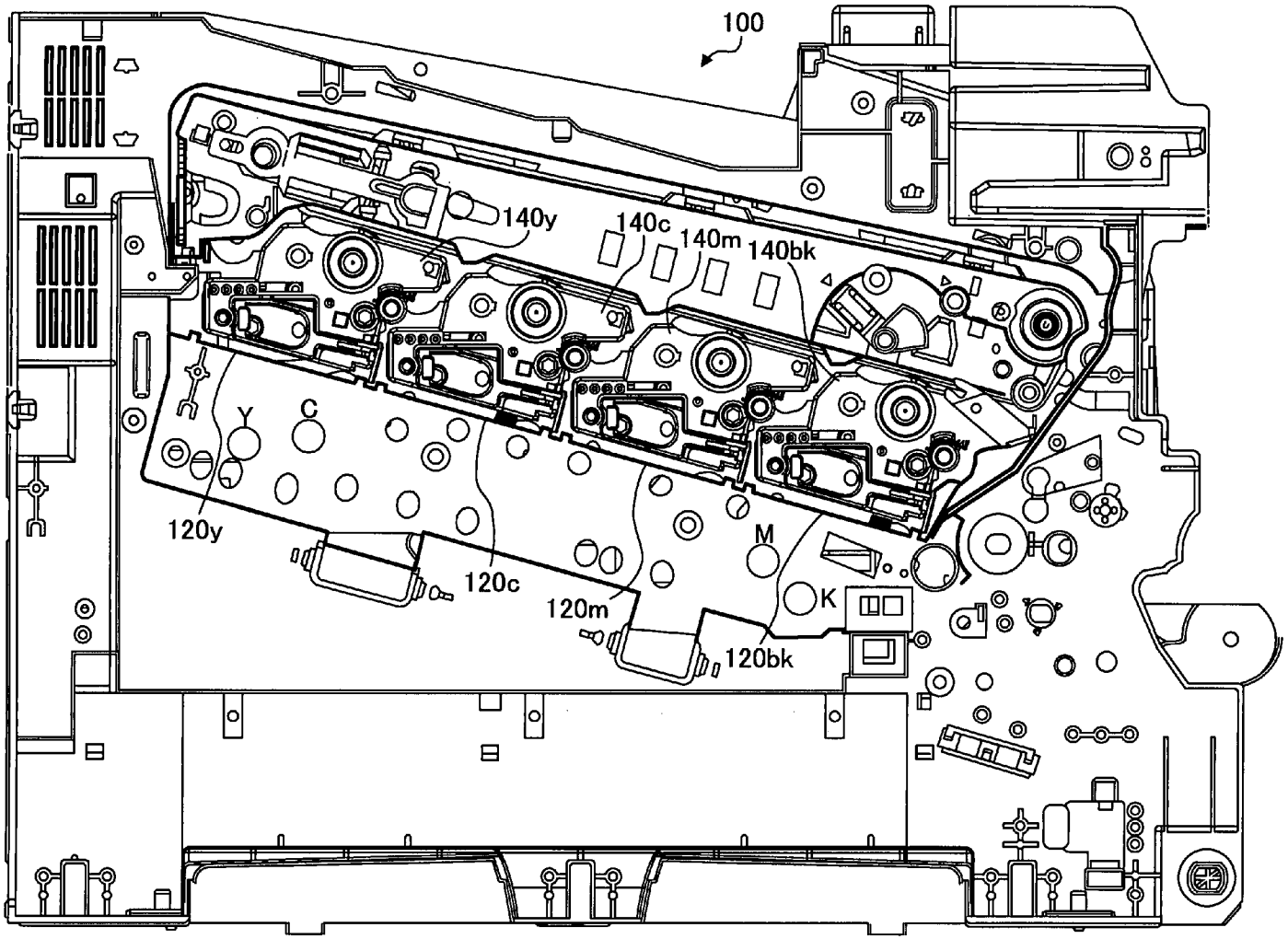
FIG. 6 illustrates a vertical sectional view of an image forming apparatus according to another embodiment of the present invention.

Next, an image forming apparatus 100 according to another embodiment of the present invention is described with reference to FIGS. 6 through 12. FIG. 6 shows an image forming apparatus 100 that includes guide portions 120*y*, 120*c*, 120*m* and 120*bk* and process cartridges 140*y*, 140*c*, 140*m* and 140*bk*. The image forming apparatus 100 is similar to the image forming apparatus 1 of FIG. 1.

In the discussion following, suffix characters "y","c","m" and "bk" are attached to reference numbers of components and represent respective colors. Based on this suffix system, the following explanation primarily focuses on the yellow color mechanism section. The remaining color mechanism sections have similar structures.

Figure 7:
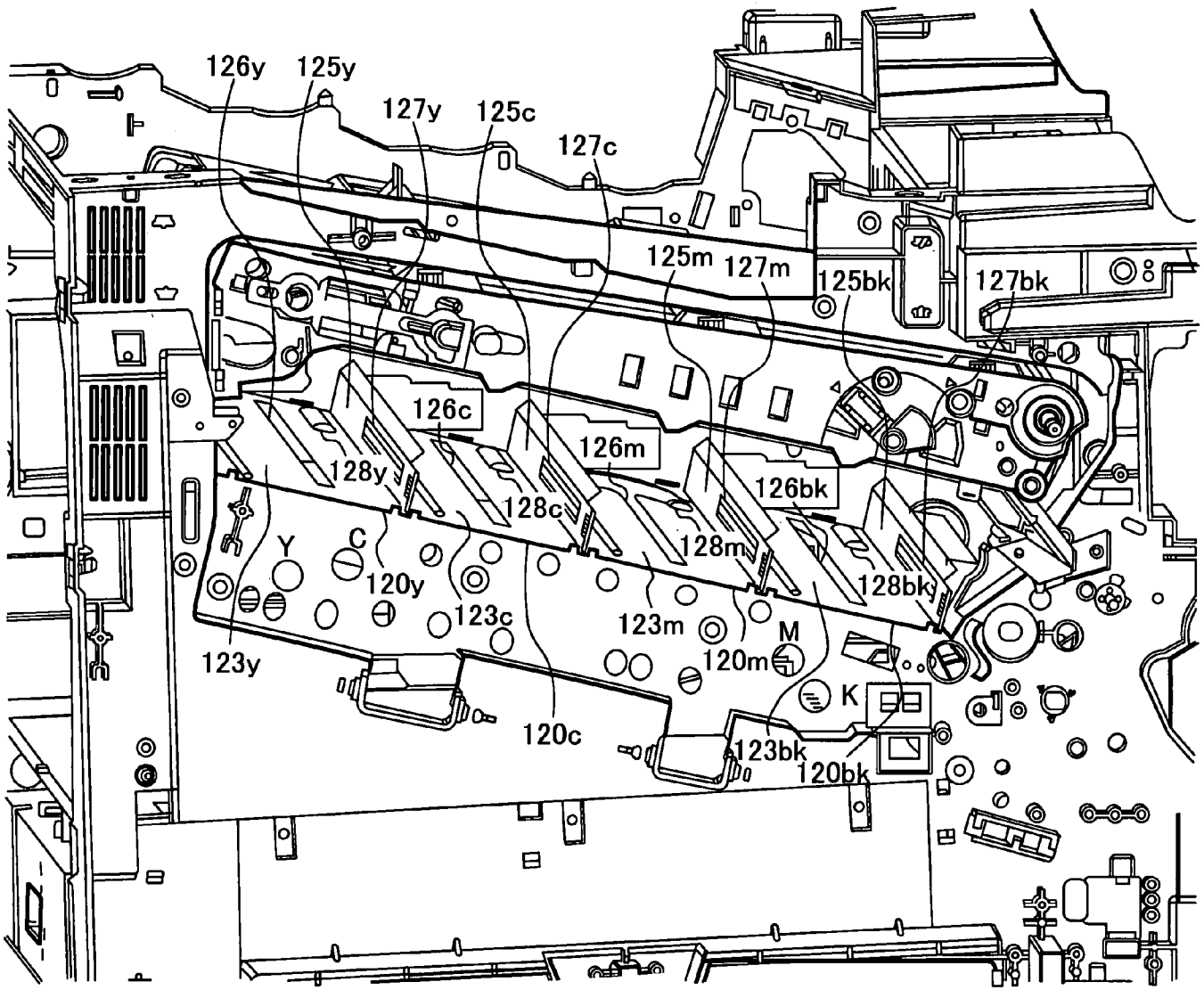
FIG. 7 illustrates a perspective view in part of the image forming apparatus of FIG. 6 showing an inside of the image forming apparatus with the process cartridges removed.
Figure 8:
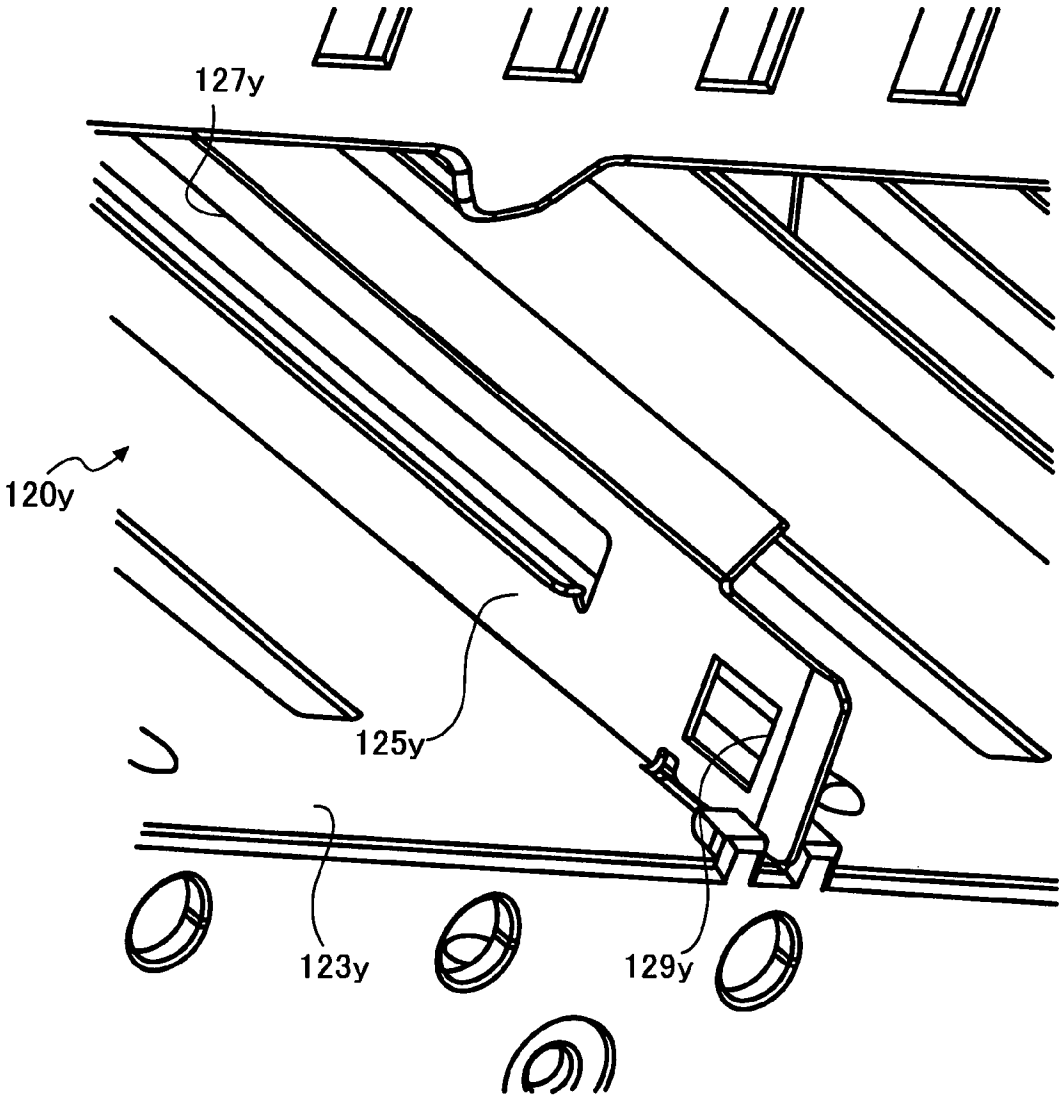
FIG. 8 illustrates an enlarged view of a guide portion of the image forming apparatus of FIG. 6.

As shown in FIG. 7, the guide portions 120*y*, 120*c*, 120*m* and 120*bk* of the image forming apparatus 100 include supporting surfaces 123*y*, 123*c*, 123*m* and 123*bk*, and regulating members 125*y*, 125*c*, 125*m* and 125*bk*. The supporting surfaces 123*y*, 123*c*, 123*m* and 123*bk* include light passing windows 126*y*, 126*c*, 126*m* and 126*bk*, and pushup members 128*y*, 128*c*, 128*m* and 128*bk*. The regulating members 125*y*, 125*c*, 125*m* and 125*bk* include guide openings 127*y*, 127*c*, 127*m* and 127*bk*. FIG. 8 illustrates a positioning hole 129*y* of the regulating member 125*y*.

Further, while each of the supporting surfaces 43*y*, 43*c*, 43*m* and 43*bk* of a corresponding one of the guide portions 42*y*, 42*c*, 42*m* and 42*bk* is arranged approximately horizontal in the image forming apparatus 1, each of the supporting surfaces 123*y*, 123*c*, 123*m* and 123*bk* of a corresponding one of the guide portions 120*y*, 120*c*, 120*m* and 120*bk* is arranged to be inclined relative to a horizontal plane in the image forming apparatus 100.

Figure 11:
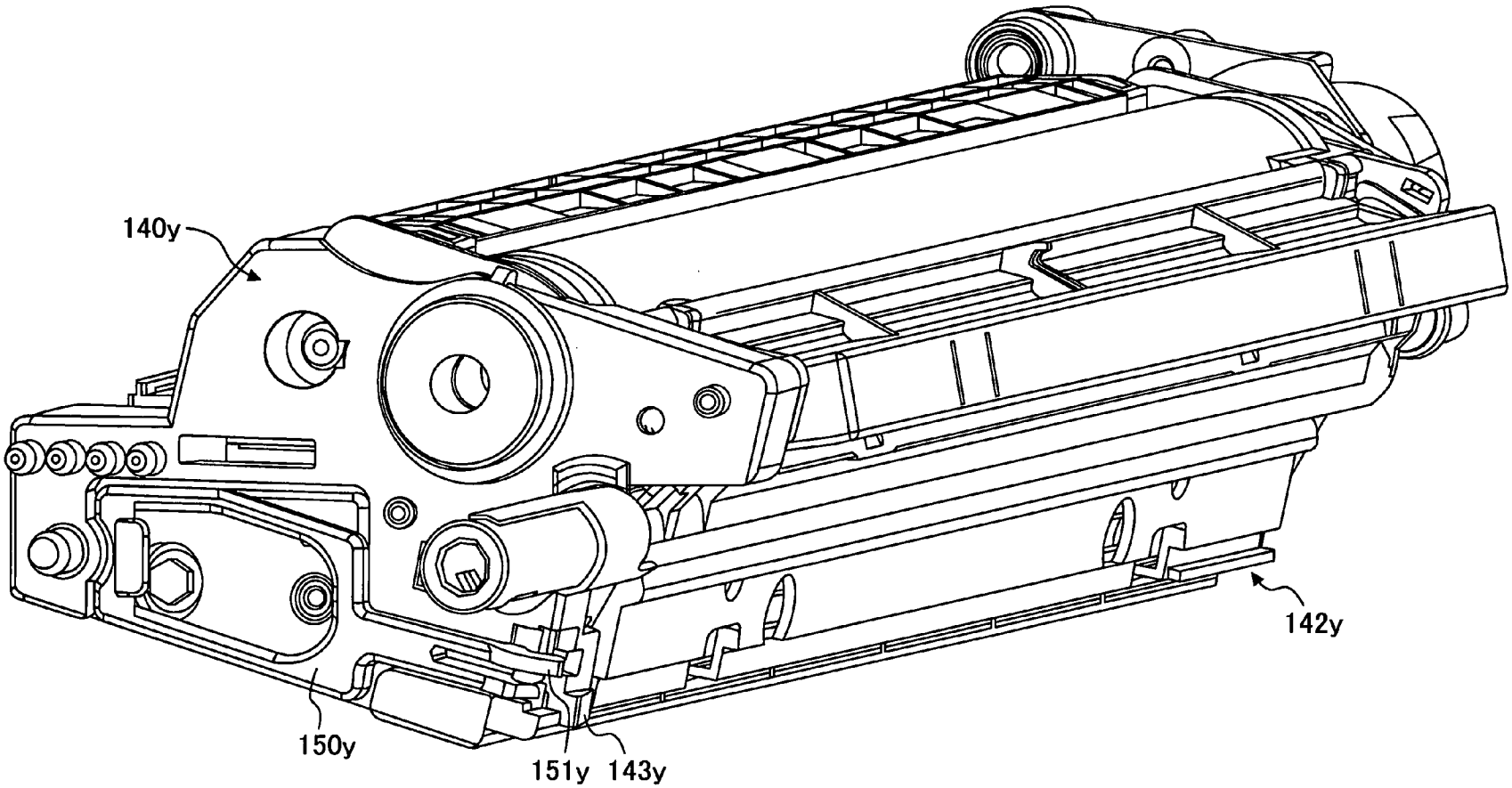
FIG. 11 illustrates a perspective view of the process cartridge from a rear side.

The process cartridges 140*y*, 140*c*, 140*m* and 140*bk* of the image forming apparatus 100, shown in FIG. 6, are similar to the process cartridges 40*y*, 40*c*, 40*m* and 40*bk*, respectively, of the image forming apparatus 1, shown in FIG. 1, with the exception of the guide portion 120*y*, for example, a convex portion 142*y*, a positioning latch 143*y*, a lever 150*y*, and a cam 151*y*, as shown in FIG. 11.

This structure allows a sliding movement of each of the process cartridges 140*y*, 140*c*, 140*m* and 140*bk* in a stable manner. More specifically, the process cartridge 140*y* slidably moves on the guide portion 120*y* while pressing down both the supporting surface 123*y* and the regulating member 125*y* by its own weight, thereby avoiding undesirable movements of the process cartridge 140*y* in a direction parallel to the supporting surface 123*y*.

Detailed structures of the guide portions 120*y*, 120*c*, 120*m* and 120*bk* and the process cartridges 140*y*, 140*c*, 140*m* and 140*bk* different from those of the guide portions 42*y*, 42*c*, 42*m* and 42*bk*, and the process cartridges 40*y*, 40*c*, 40*m* and 40*bk* are now described.

FIG. 7 shows the inside of the image forming apparatus 100 when the process cartridges 140*y*, 140*c*, 140*m* and 140*bk* are removed. Each of the guide portions 120*y*, 120*c*, 120*m* and 120*bk* has an L-shaped form. The supporting surfaces 123*y*, 123*c*, 123*m* and 123*bk* support the bottom surfaces of the process cartridges 140*y*, 140*c*, 140*m* and 140*bk*, respectively. The light passing windows 126*y*, 126*c*, 126*m* and 126*bk* are included in the supporting surfaces 123*y*, 123*c*, 123*m* and 123*bk*, respectively. Each of the light passing windows 126*y*, 126*c*, 126*m* and 126*bk* passes a laser beam emitted by an optical writing system which is positioned under the guide portions 120*y*, 120*c*, 120*m* and 120*bk*. The supporting surfaces 123*y*, 123*c*, 123*m* and 123*bk* include pushup members 128*y*, 128*c*, 128*m* and 128*bk*, respectively. The pushup members 128*y*, 128*c*, 128*m* and 128*bk* guide the process cartridges 140*y*, 140*c*, 140*m* and 140*bk*, respectively, such that the process cartridges 140*y*, 140*c*, 140*m* and 140*bk* are pushed up to positions contacting the intermediate transfer belt. The regulating members 125*y*, 125*c*, 125*m* and 125*bk* are arranged approximately perpendicular to the supporting surfaces 123*y*, 123*c*, 123*m* and 123*bk*, respectively. The regulating members 125*y*, 125*c*, 125*m* and 125*bk* regulate movement of the process cartridges 140*y*, 140*c*, 140*m* and 140*bk*, respectively, to precision positions. The regulating members 125*y*, 125*c*, 125*m* and 125*bk* include guide openings 127*y*, 127*c*, 127*m* and 127*bk* and positioning holes 129*y*, 129*c*, 129*m* and 129*bk*, respectively. Each of the guide openings 127*y*, 127*c*, 127*m* and 127*bk* guides a corresponding one of the process cartridges 140*y*, 140*c*, 140*m* and 140*bk*. Each of the positioning holes 129*y*, 129*c*, 129*m* and 129*bk* is positioned at one edge side of the regulating member close to the cover plate 71, and determines a preliminary operable position of a corresponding one of the process cartridges 140*y*, 140*c*, 140*m* and 140*bk*, respectively.

Referring to FIGS. 8 through 12, the guide portion 120*y* and the process cartridge 140*y* are primarily shown. The guide portions 120*y*, 120*c*, 120*m* and 120*bk* have identical structures. The process cartridges 140*y*, 140*c*, 140*m* and 140*bk* also have identical structures with toners different in colors from each other.

FIG. 8 shows an enlarged view of the guide portion 120*y*. When the process cartridge 140*y* is slid on the angled supporting surface 123*y*, the process cartridge 140*y* presses by its own weight the supporting surface 123*y* such that undesirable movements in a direction different from the sliding direction are eliminated. The convex portion 142*y*, shown in FIG. 11, is included at a leading portion of the process cartridge 140*y* and is configured to be engaged with the guide opening 127*y* formed on the regulating member 125*y* of the guide portion 120*y*. This regulates movements of the process cartridge 140*y* towards the intermediate transfer belt such that the process cartridge 140*y* may maintain a distance from the intermediate transfer belt. This prevents damage to a photoconductive drum of the process cartridge 140*y* and the intermediate transfer belt. When the process cartridge 140*y* is inserted into the image forming apparatus 100 a certain distance corresponding to a predetermined length of the guide portion 120*y*, the convex portion 142*y* of the process cartridge 140*y* moves off the guide opening 127*y*. Then, as the process cartridge 140*y* is inserted, the process cartridge 140*y* is lifted in a vertical direction by and onto the pushup member 128*y* of the supporting surface 123*y*. As a result, the photoconductive drum of the process cartridge 140*y* contacts the intermediate transfer belt.

To avoid damage to the intermediate transfer belt, the process cartridge 140*y* is preferably separated from the intermediate transfer belt when the process cartridge 140*y* is installed. However, the process cartridge 140*y* needs to be set to a predetermined preliminary position and held in contact with the intermediate transfer belt to perform the image forming operation. As previously described, when the process cartridge 140*y* is inserted into the image forming apparatus 100, it is guided by the guide opening 127*y* of the regulating member 125*y* and the pushup member 128*y* of the supporting surface 123*y*. At the preliminary position, the positioning latch 143*y* of the process cartridge 140*y* is detented into the positioning hole 129*y* of the guide portion 120*y* such that the positioning latch 143*y* and the positioning hole 129*y* are engaged to determine the preliminary position of the process cartridge 140*y*. The process cartridge 140*y* located at the preliminary position is fixed to a precision position by closing the cover plate 71.

Figure 9:
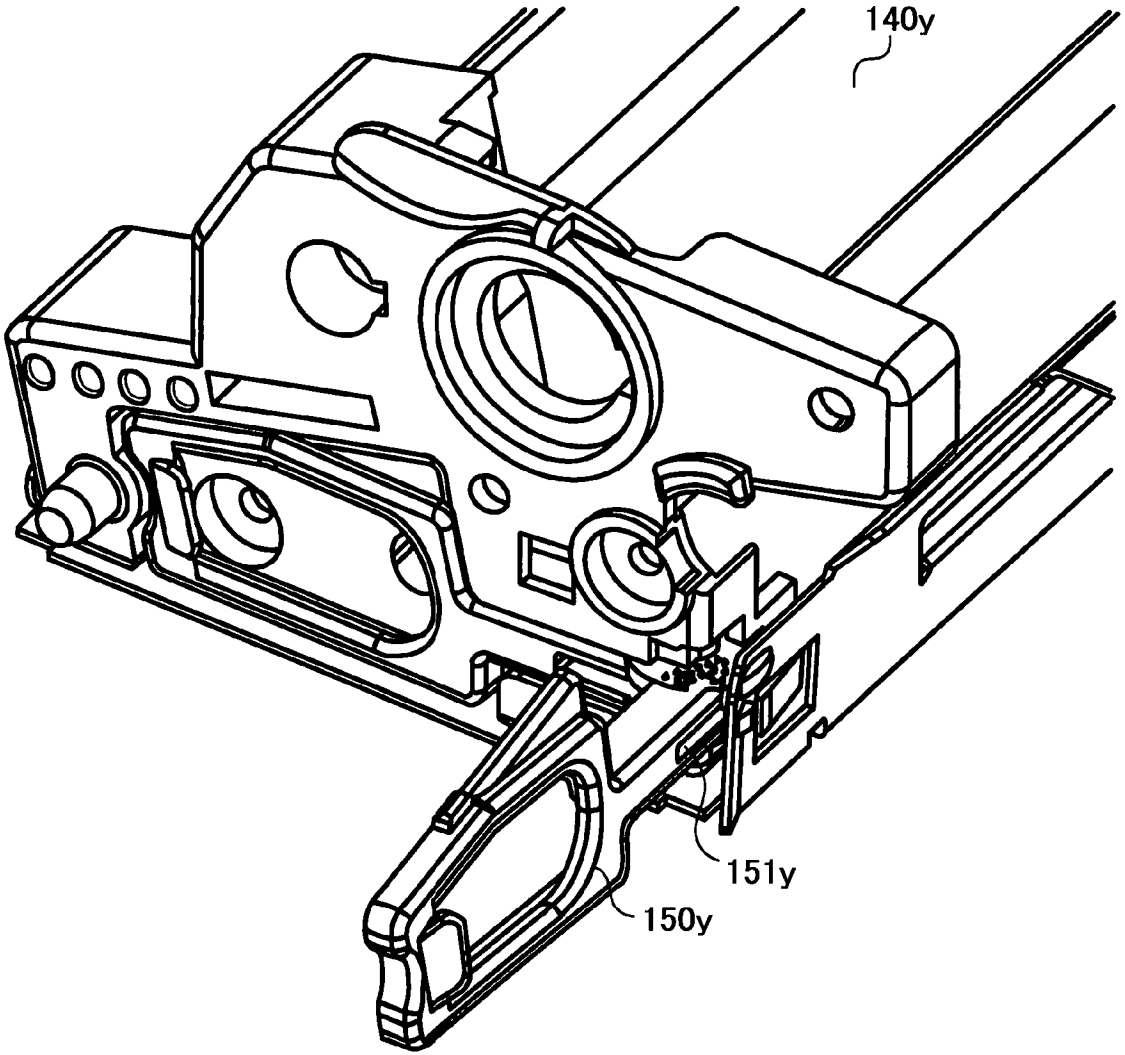
FIG. 9 illustrates a perspective view in part of a process cartridge with a lever positioned at a release position at which the process cartridge is released from the guide portion.
Figure 10:
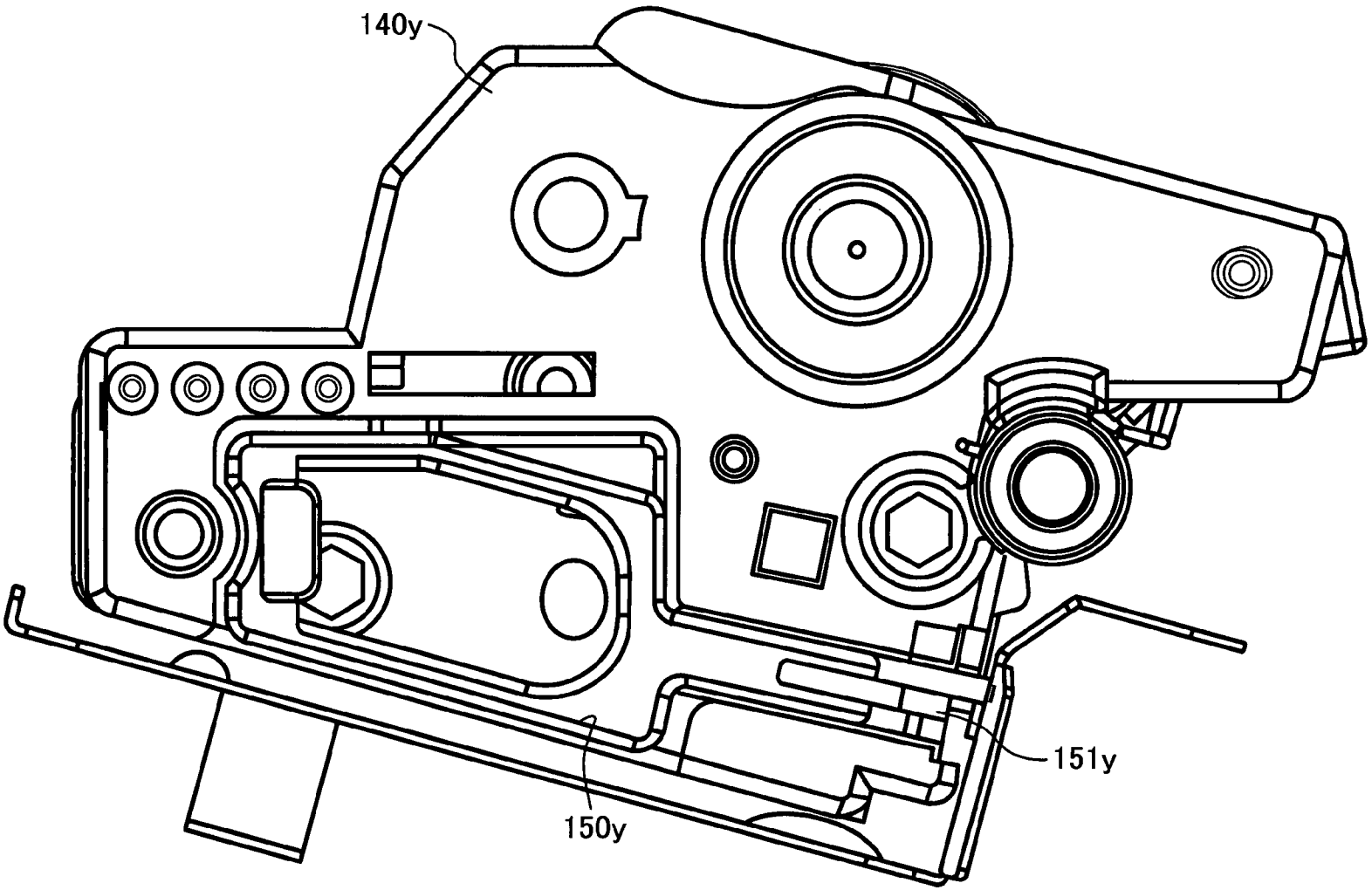
FIG. 10 illustrates a side view of the process cartridge with the lever at a locking position at which the process cartridge is locked to the guide portion.
Figure 12:
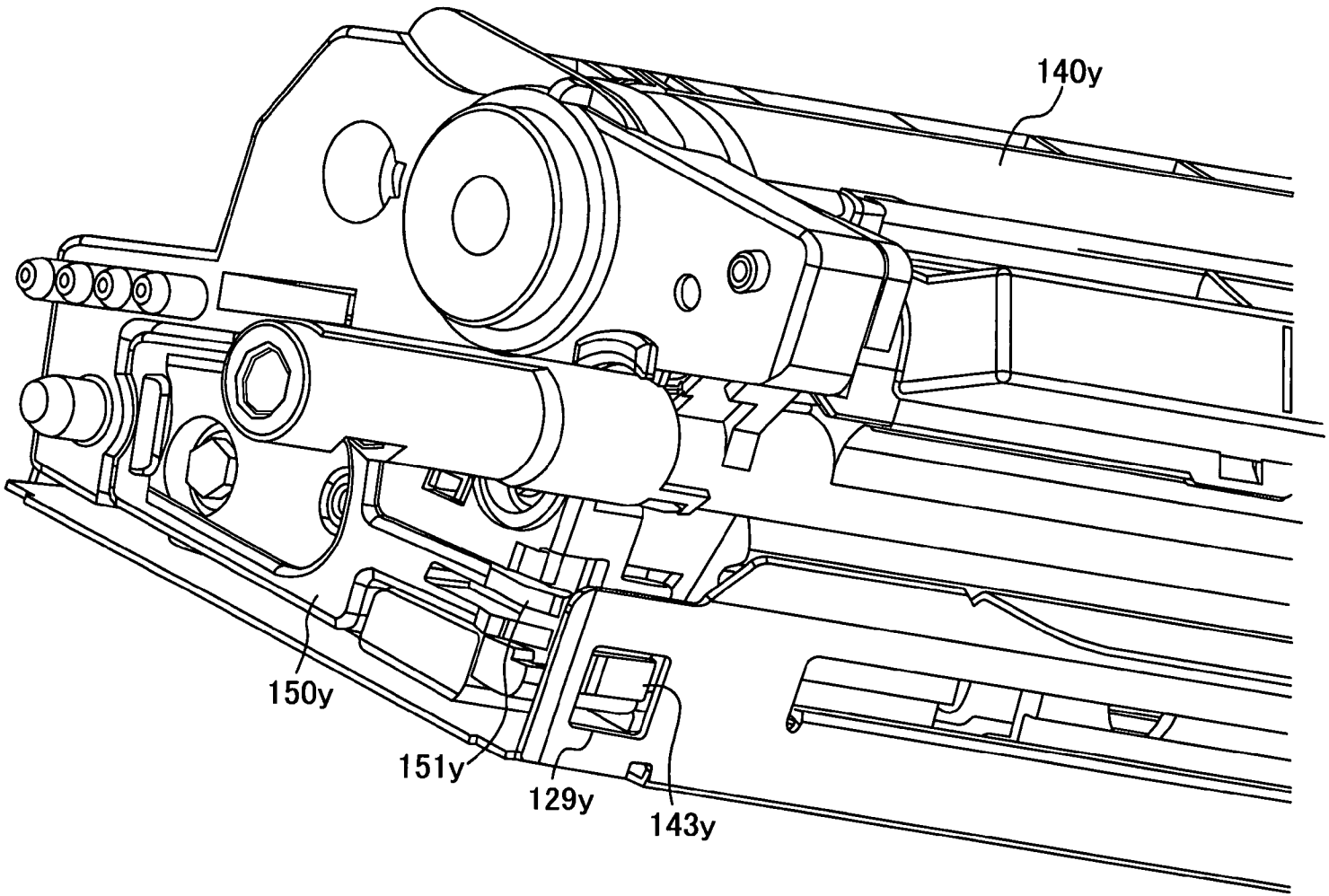
FIG. 12 illustrates an enlarged view in part of the process cartridge from the rear side.

FIGS. 9 and 12 show installation and removal of the process cartridge 140*y*. In this embodiment of the present invention, the image forming apparatus 100 has the positioning hole 129*y* and the positioning latch 143*y*. When the process cartridge 140*y* is inserted, the positioning latch 143*y* of the process cartridge 140*y* fits in the positioning hole 129*y* of the guide portion 120*y* by the weight of the process cartridge 140*y*. Thus, the process cartridge 140*y* is set to the preliminary position and a locking pressure is applied such that the process cartridge 140*y* is locked. The process cartridge 140*y* is then fixed to the precision position by the cover plate 71 as previously described. To release the process cartridge 140*y* located at the precision position, the lever 150*y* of the process cartridge 140*y* is used.

As previously described, the process cartridge 140*y* has the lever 150*y* which is arranged at a position close to the positioning latch 143*y*. The lever 150*y* is pulled out, and the cam 151*y* provided at a hinge portion of the lever 150*y* contacts the regulating member 125*y* of the guide portion 120*y* and pushes up the process cartridge 140*y*. The positioning latch 143*y* of the process cartridge 140*y* is disengaged from the positioning hole 129*y* of the guide portion 120*y*. The process cartridge 140*y* is then easily removed by pulling the lever 150*y*.

FIG. 11 is a perspective view of the process cartridge 140*y* and FIG. 12 is an enlarged view of a part of the process cartridge 140*y*. A bottom side of the process cartridge 140*y* is formed approximately flat so that the process cartridge 140*y* is smoothly inserted along the guide portion 120*y*. The convex portion 142*y* of the process cartridge 140*y* is arranged at a lower part of the process cartridge 140*y* to face the regulating member 125*y* and to be close to the pushup member 128*y* when the process cartridge 140*y* is in an operational position.

A process cartridge having a structure of the present invention may easily and smoothly be installed and removed along a guide member eliminating undesirable movements by its own weight.

Similar to the image forming apparatus 1, the image forming apparatus 100 of the present invention includes toner bottles (not shown in FIG. 6) which are separately mounted to the process cartridges 140*y*, 140*c*, 140*m* and 140*bk*. Namely, the toner bottles may be replaced separately from the process cartridges 140*y*, 140*c*, 140*m* and 140*bk* when toner needs to be replenished. Also, the process cartridges 140*y*, 140*c*, 140*m* and 140*bk* may be replaced separately from the toner bottles when a component needs to be replaced.

Obviously, numerous modifications and variations of the present invention are possible in light of the above teachings. It is therefore to be understood that within the scope of the appended claims, the present invention may be practiced otherwise than as specifically described herein.

The invention claimed is:

1. An image forming apparatus, comprising:

a frame;

a plurality of process cartridges; and a guide mounted to the frame, the guide including a plurality of guide portions having supporting surfaces including respective bottom and side surfaces configured to support respective of the plurality of process cartridges, and arranged at predetermined different heights and on which the plurality of process cartridges are detachably placed, and configured to guide the plurality of process cartridges placed on the supporting surfaces along a path between respective first positions and respective second positions.

2. The image forming apparatus according to claim 1, wherein the plurality of process cartridges sequentially form color toner images with toners of predetermined colors different from each other to form a full-color image in each of image forming cycles, each of the plurality of process cartridges comprising:

an image bearing member having a surface on which a latent image for a toner of a corresponding color of the toners of the predetermined colors is formed; and at least a part of an image forming mechanism integrally mounted with the image bearing member, the image forming mechanism being configured to form a corresponding color toner image based on the latent image formed on the image bearing member.

3. The image forming apparatus according to claim 2, wherein each of the supporting surfaces of the plurality of guide portions arranged at the predetermined different heights is arranged to be inclined relative to a horizontal plane.

4. The image forming apparatus according to claim 3, wherein each of the plurality of guide portions comprises a plurality of supporting members configured to respectively contact at least bottom and side surfaces of a corresponding process cartridge among the plurality of process cartridges to support the corresponding process cartridge.

5. The image forming apparatus according to claim 4, wherein the plurality of supporting members included in each of the plurality of guide portions of the guide comprise respective regulators having a predetermined length for regulating movements of a corresponding process cartridge of the plurality of process cartridges in respective directions other than a moving direction of the corresponding process cartridge during a time the corresponding process cartridge is guided.

6. The image forming apparatus according to claim 5, wherein the predetermined length of the respective regulators is shorter than an entire length of the corresponding process cartridge.

7. The image forming apparatus according to claim 5, wherein one of the respective regulators of the plurality of supporting members included in each of the plurality of guide portions of the guide determines a predetermined precision position for the corresponding process cartridge of the plurality of process cartridges in a length direction of the corresponding process cartridge at a corresponding one of the second positions.

8. The image forming apparatus according to claim 7, wherein each of the plurality of process cartridges includes a lever configured to be moved between set and release positions and to set the corresponding process cartridge of the plurality of process cartridges to the predetermined precision position and to release the corresponding process cartridge from the predetermined precision position.

9. The image forming apparatus according to claim 3, further comprising:

a transfer belt including a belt portion held in contact with the image bearing member of each of the plurality of process cartridges, wherein the belt portion of the transfer belt and a slope that each of the supporting surfaces of the plurality of guide portions is arranged to be inclined relative to the horizontal plane are parallel to each other.

10. The image forming apparatus according to claim 2, further comprising:

a cover configured to be moved between opening and closing positions and having a precision positioning shape for fixing the image bearing members of the plurality of process cartridges located at the respective second positions to predetermined precision positions when being moved to the closing position.

11. The image forming apparatus according to claim 2, further comprising:

a plurality of toner bottles for containing the toners of the predetermined colors different from each other, wherein each of the plurality of toner bottles is configured to be detachable from the image forming apparatus independent from a corresponding process cartridge of the plurality of process cartridges.

12. The image forming apparatus according to claim 1, wherein each of the respective first positions is a position at which a corresponding process cartridge of the plurality of process cartridges is placed for installation and is removed for exchange, and each of the respective second positions is a position at which a corresponding process cartridge of the plurality of process cartridges is made operable, the respective second positions being arranged in line with a decrease in vertical height along a direction such that a position of the respective second positions having a lowest vertical height is a position for a process cartridge that lastly forms a toner image among the plurality of process cartridges in one image forming cycle.

13. The image forming apparatus according to claim 1, wherein each of the supporting surfaces of the plurality of guide portions arranged at the predetermined different heights is arranged approximately horizontal.

14. The image forming apparatus according to claim 1, wherein each of the plurality of guide portions includes a regulating member for regulating a displacement movement of a corresponding process cartridge among the plurality of process cartridges in a direction parallel to the supporting surfaces and perpendicular to a moving direction of the corresponding process cartridge during a time the corresponding process cartridge is guided by a corresponding guide portion of the plurality of guide portions.

15. The image forming apparatus according to claim 1, wherein each of the plurality of guide portions includes a regulating member for rejecting placement of an incorrect process cartridge among the plurality of process cartridges.

16. The image forming apparatus according to claim 1, wherein the guide is configured to move in a vertical direction.

17. The image forming apparatus according to claim 1, wherein the plurality of guide portions of the guide are configured to move individually in a vertical direction.

18. An image forming apparatus, comprising:

a frame;

a plurality of process cartridges configured to sequentially form color toner images with toners of predetermined colors different from each other to form a full-color image in each image forming cycle; and means for holding the plurality of process cartridges that are downwardly placed thereto at predetermined different heights and for guiding the plurality of process cartridges along a path between respective first positions to respective second positions, the means for holding including respective bottom and side surfaces configured to support respective of the plurality of process cartridges.

19. The image forming apparatus according to claim 18, wherein the plurality of process cartridges sequentially form the color toner images with the toners of the predetermined colors different from each other to form a full-color image in each of image forming cycles, each of the plurality of process cartridges comprising:

an image bearing member for bearing a latent image for a toner of a corresponding color of the toners of the predetermined colors; and an image forming member for forming a corresponding color toner image based on the latent image formed by the image bearing member.

20. The image forming apparatus according to claim 18, wherein each of the respective first positions is a position at which a corresponding process cartridge of the plurality of process cartridges is placed or removed and each of the respective second positions is a position at which a corresponding process cartridge of the plurality of process cartridges is made operable.

21. The image forming apparatus according to claim 18, wherein the means for holding and for guiding includes guiding supporting surfaces arranged approximately horizontal for supporting the plurality of process cartridges.

22. The image forming apparatus according to claim 21, wherein the means for holding and for guiding includes a plurality of regulating members each for regulating a displacement movement of a corresponding process cartridge among the plurality of process cartridges in a direction parallel to the supporting surfaces and perpendicular to a moving direction of the corresponding process cartridge during a time the corresponding process cartridge is guided by the means for holding and for guiding.

23. The image forming apparatus according to claim 18, wherein the means for holding and for guiding includes supporting surfaces arranged to be inclined relative to a horizontal plane for supporting the plurality of process cartridges.

24. The image forming apparatus according to claim 23, wherein the means for holding and for guiding contacts at least bottom and side surfaces of a corresponding process cartridge among the plurality of process cartridges to support the corresponding process cartridge.

25. The image forming apparatus according to claim 23, further comprising:

means for superimposing the color toner images formed by the plurality of process cartridges at a plurality of superimposing points, wherein a plane connecting the plurality of superimposing points provided by the means for superimposing and a slope that each of the supporting surfaces of the means for holding and guiding is arranged to be inclined relative to the horizontal plane are parallel to each other.

26. The image forming apparatus according to claim 25, wherein the means for holding and for guiding moves the plurality of process cartridges in contact with the image superimposing means in a direction away from the means for superimposing and perpendicular to a plane of the image superimposing points.

27. The image forming apparatus according to claim 26, wherein the means for holding and for guiding moves each of the plurality of process cartridges individually.

28. The image forming apparatus according to claim 23, wherein the means for holding and for guiding regulates movements of a corresponding process cartridge of the plurality of process cartridges for a predetermined distance in respective directions other than a moving direction of the corresponding process cartridge during a time the means for holding and for guiding guides the corresponding process cartridge.

29. The image forming apparatus according to claim 28, wherein the predetermined distance is shorter than an entire length of the corresponding process cartridge.

30. The image forming apparatus according to claim 28, wherein the means for holding and for guiding determines a predetermined precision position for a corresponding process cartridge of the plurality of process cartridges in a length direction of the corresponding process cartridge at a corresponding one of the second positions.

31. The image forming apparatus according to claim 18, wherein the means for holding and for guiding includes a plurality of regulating members each for rejecting placement of an incorrect process cartridge among the plurality of process cartridges.

32. The image forming apparatus according to claim 18, further comprising:

means for enclosing and fixing the plurality of process cartridges at predetermined precision positions.

33. The image forming apparatus according to claim 32, wherein each of the plurality of process cartridges includes a lever configured to be moved between set and release positions and to set a corresponding process cartridge of the plurality of process cartridges to the predetermined precision position and to release the corresponding process cartridge from the predetermined precision position.

34. The image forming apparatus according to claim 18, further comprising:

a plurality of toner bottles for containing the toners of the predetermined colors different from each other, wherein each of the plurality of toner bottles is configured to be detachable from the image forming apparatus independent from a corresponding process cartridge of the plurality of process cartridges.

35. A method of a process cartridge loading arrangement for an image forming apparatus, comprising:

providing a guide including a plurality of guide portions having supporting surfaces arranged at predetermined different heights and including respective bottom and side surfaces configured to support respective of a plurality of process cartridges and placing a plurality of the process cartridges detachably on the supporting surfaces of the plurality of guide portions of the guide; and guiding the plurality of process cartridges placed on the supporting surfaces from respective first positions to respective second positions.

36. The method according to claim 35, wherein the plurality of process cartridges sequentially form color toner images with toners of predetermined colors different from each other to form a full-color image in each of image forming cycles, each of the plurality of process cartridges comprising:

an image bearing member having a surface on which a latent image for a toner of a corresponding color of the toners of the predetermined colors is formed; and at least a part of an image forming mechanism integrally mounted with the image bearing member, the image forming mechanism being configured to form a corresponding color toner image based on the latent image formed on the image bearing member.

37. The method according to claim 36, further comprising:

providing a plurality of toner bottles for containing the toners of the predetermined colors different from each other, wherein each of the plurality of toner bottles is configured to be detachable from the image forming apparatus independent from a corresponding process cartridge of the plurality of process cartridges.

38. The method according to claim 35, wherein each of the respective first positions is a position at which a corresponding process cartridge of the plurality of process cartridges is placed for installation and is removed for exchange, and each of the respective second positions is a position at which a corresponding process cartridge of the plurality of process cartridges is made operable, the respective second positions being arranged in line with a decrease in vertical height along a direction such that a position of the respective second positions having a lowest vertical height is a position for a process cartridge that lastly forms a toner image among the plurality of process cartridges in one image forming cycle.

39. The method according to claim 35, wherein each of the supporting surfaces of the plurality of guide portions arranged at the predetermined different heights is arranged approximately horizontal.

40. The method according to claim 35, wherein each of the supporting surfaces of the plurality of guide portions arranged at the predetermined different heights is arranged to be inclined relative to a horizontal plane.

41. The method according to claim 40, wherein each of the plurality of guide portions comprises a plurality of supporting members configured to respectively contact at least bottom and side surfaces of a corresponding process cartridge of the plurality of process cartridges to support the corresponding process cartridge.

42. The method according to claim 41, wherein one of the respective regulators of the plurality of supporting members included in each of the plurality of guide portions of the guide determines a predetermined precision position for a corresponding process cartridge of the plurality of process cartridges in a length direction of the corresponding process cartridge at a corresponding one of the respective second positions.

43. The method according to claim 42, wherein each of the plurality of process cartridges includes a lever configured to be moved between set and release positions and to set a corresponding process cartridge of the plurality of process cartridges to the predetermined precision position and to release the corresponding process cartridge from the predetermined precision position.

44. The method according to claim 40, further comprising:

arranging a transfer belt such that a belt portion of the transfer belt contacts image bearing members of the plurality of process cartridges and is parallel to a slope at which each of the supporting surfaces of the plurality of guide portions is arranged.

45. The method according to claim 40, wherein the plurality of supporting members included in each of the plurality of guide portions of the guide comprise respective regulators having a predetermined length for regulating movements of a corresponding process cartridge of the plurality of process cartridges in respective directions other than a moving direction of the corresponding process cartridge during a time a corresponding guide portion of the plurality of guide portions guides the corresponding process cartridge.

46. The method according to claim 45, wherein the predetermined length of the respective regulators is shorter than an entire length of the corresponding process cartridge.

47. The method according to claim 35, wherein each of the plurality of guide portions includes a regulating member for regulating a displacement movement of a corresponding process cartridge among the plurality of process cartridges in a direction parallel to the supporting surfaces and perpendicular to a moving direction of the corresponding process cartridge during a time the corresponding process cartridge is guided by a corresponding guide portion of the plurality of guide portions.

48. The method according to claim 35, wherein each of the plurality of guide portions includes a regulating member for rejecting placement of an incorrect process cartridge among the plurality of process cartridges.

49. The method according to claim 35, wherein the guide is configured to move in a vertical direction.

50. The method according to claim 35, wherein the plurality of guide portions of the guide are configured to move individually in a vertical direction.

51. The method according to claim 35, further comprising:

moving a cover to a closing position to fix image bearing members of the plurality of process cartridges located at the respective second positions to predetermined precision positions.

* * * * *